US006726088B2

(12) United States Patent
Waldburger et al.

(10) Patent No.: US 6,726,088 B2
(45) Date of Patent: Apr. 27, 2004

(54) CARTON AND CARTON BLANK

(75) Inventors: Peter Waldburger, Mississauga (CA); Andre Odilon Bernatchez, Mississauga (CA); Jamie Alan MacLean, Mississauga (CA); Edwin John Fox, Mississauga (CA); Gregory Nathaniel Kimmett, Mississauga (CA)

(73) Assignee: Cascades Boxboard Inc., Ontario (CA)

( * ) Notice: Subject to any disclaimer, the term of this patent is extended or adjusted under 35 U.S.C. 154(b) by 140 days.

(21) Appl. No.: 10/191,652

(22) Filed: Jul. 9, 2002

(65) Prior Publication Data

US 2002/0179700 A1 Dec. 5, 2002

Related U.S. Application Data

(63) Continuation-in-part of application No. 09/699,965, filed on Oct. 30, 2000, now Pat. No. 6,520,404.

(51) Int. Cl.[7] ..... B65D 5/08

(52) U.S. Cl. ..... 229/137; 229/215; 229/221; 493/162; 493/183

(58) Field of Search ..... 229/137, 138, 229/139, 183, 184, 215, 217, 221, 229; 493/162, 183

(56) References Cited

U.S. PATENT DOCUMENTS

| | | | | |
|---|---|---|---|---|
| 355,862 | A | 1/1887 | Clark | 229/137 |
| 356,747 | A | 2/1887 | Clark | 229/184 |
| 1,994,923 | A | 3/1935 | Ross | 229/137 |
| 2,646,917 | A | 7/1953 | Smith | 229/184 |
| 2,819,831 | A | 1/1958 | Polarek et al. | 229/221 |
| 3,229,890 | A | 1/1966 | Wright | 229/137 |
| 3,348,756 | A | 10/1967 | Boysen | 229/184 |
| 3,750,932 | A | 8/1973 | Ellison | 229/138 |
| 3,797,726 | A | 3/1974 | Reil | 229/137 |
| 3,801,001 | A | 4/1974 | Taylor | 229/139 |
| 3,961,742 | A | 6/1976 | Stark et al. | 229/137 |
| 4,192,446 | A | 3/1980 | Naito | 229/137 |
| 4,211,357 | A | 7/1980 | Lisiecki | 229/248 |
| 4,267,957 | A | 5/1981 | Holmström | 229/137 |
| 4,836,384 | A | 6/1989 | Tuns et al. | 206/221 |
| 4,991,768 | A | 2/1991 | Kondo | 229/137 |
| 5,133,497 | A | 7/1992 | Küppersbusch | 229/183 |
| 5,150,833 | A | 9/1992 | Hong | 229/215 |
| D358,087 | S | 5/1995 | Lowry | D9/311 |
| 5,413,273 | A | 5/1995 | Money | 229/138 |
| D364,805 | S | 12/1995 | Hata | D9/432 |
| 6,056,680 | A | 5/2000 | Spronk-Dik | 493/151 |
| D437,222 | S | 2/2001 | Goldberg | D9/432 |
| 6,520,404 | B1 * | 2/2003 | Waldburger et al. | 229/137 |

FOREIGN PATENT DOCUMENTS

| | | |
|---|---|---|
| CH | 424 613 | 11/1996 |
| FR | 2 356 565 | 1/1978 |
| FR | 2 731 204 | 9/1996 |

OTHER PUBLICATIONS

"EXPRESSO—Tight without an inner bag."; brochure of AB Akerlund & Rausing, P.O. Box 22, S–22100 Lund, Sweden.

The Wiley Encyclopedia of Packaging Technology, John Wiley & Sons, pp. 4, 5, 140, 141 (1986).

* cited by examiner

*Primary Examiner*—Gary E. Elkins
(74) *Attorney, Agent, or Firm*—Arnold B. Silverman; Eckert Seamans Cherin & Mellott, LLC

(57) ABSTRACT

The top of a carton, with opposite main panels and opposite side panels, has an inner and outer major flap hinged to opposite main panels. The outer major flap has a fold line extending along its length in parallel to a hinge line joining the outer major flap and a main panel. At each side panel, an ear has an ear portion hinged to the side panel and an ear portion hinged to the outer major flap. With this arrangement, the carton may be re-closed by pressing the ears down against the outer major flap so that the outer major flap folds about fold line into a concave V-shape.

25 Claims, 9 Drawing Sheets

CARTON AND CARTON BLANK

This application is a continuation-in-part of U.S. application Ser. No. 09/699,965 filed Oct. 30, 2000 now U.S. Pat. No. 6,520,404.

FIELD OF THE INVENTION

This invention relates to a carton blank and a carton.

BACKGROUND

Food must generally be packaged in air tight packaging to avoid infestations. Traditional cereal boxes have four flaps: two end flaps which fold in and are overlain by an interior major flap and an outer major flap. Such a box leaves pin hole openings to its interior at its corners. Thus, to be suitable to contain food, these cereal boxes are provided with an interior air tight bag.

A number of carton designs are known which provide an air tight carton avoiding the need for an air tight bag. One such carton design is used in many milk cartons and is described, in one variation, in U.S. Pat. No. 4,211,357 to Lisiecki issued Jul. 8, 1980. The carton bottom has two major flaps and two end panels which are ears joined between the two major flaps. A heat seal adhesive is applied to the ears and one major flap then the ears are folded in and the major flaps folded down while the carton sits on a mandrel. Pressure and heat is then applied to seal the bottom. The carton top comprises two ears joined between two major panels. The two ears are folded in and a heat seal adhesive applied to the inside top margin of one of the major panels. The top margins of the major panels are then pressed together while heated to seal same. This results in a gable top.

While a gable top carton allows the carton to be sealed after filling, there is considerable empty head space in the carton. The gable top also precludes stacking of the cartons.

Another carton design, often used for long shelf life storage of juice or other liquids, comprises a sleeve with, at its top and bottom, two major panels which each terminate in an ear-half at either end. For each pair of major panels, a heat seal surface is provided on the inside face of the margin of the major panels. After applying a heat sealable material, the pair of major panels is pressed together with heat to form a fin seal. This also joins opposed ear-halves; the ears are then folded down and spot glued to the carton.

The fin sealed carton makes better use of the interior volume of the carton, however, re-closing of such a carton after opening presents difficulties. In some such cartons, it is contemplated that the carton is opened by cutting through the fin seal: in such case, re-closing is not possible. In other such cartons, a re-closeable flap (e.g., a plastic fitment) may be added to the top of the carton. However, such a flap provides only a relatively small access area to the inside of the carton. Thus, while such a flap may be adequate for a carton containing a liquid, in many instances it may not be adequate for a carton containing dry goods.

Both gable top and fin seal cartons require application of pressure from opposite sides to seal the carton top, as well as the presence of a heat sealable material. This increases the difficulty of manufacturing such cartons.

U.S. Pat. No. 6,056,680 issued May 2, 2000 to Spronk-Dik describes an airtight carton which requires the adhesion of a separate material strip to the carton blank.

Accordingly, a need remains for a carton which provides one or more of the following features: an air tight seal prior to initial opening, the ability to be re-closed, and a relatively large access area on opening.

SUMMARY OF THE INVENTION

The top of a carton, with opposite main panels and opposite side panels, has an inner and outer major flap hinged to opposite main panels. The outer major flap has a fold line extending along its length in parallel to a hinge line joining the outer major flap and a main panel. At each side panel, an ear has an ear portion hinged to the side panel and an ear portion hinged to the outer major flap. With this arrangement, the carton may be re-closed by pressing the ears down against the outer major flap so that the outer major flap folds about fold line into a concave V-shape.

Accordingly, the present invention provides a carton comprising: a first main panel; a second main panel; a pair of opposed side panels hinged between said main panels; an inner major flap extending along said first main panel and hinged thereto; an outer major flap extending along said second main panel and hinged thereto, said outer major flap having a width so as to overlap along its length with said inner major flap, said outer major flap having a fold line extending the length of said outer major flap and paralleling a hinge line joining said outer major flap to said second main panel; a pair of opposed outwardly projecting ears, each ear having a side panel portion extending from a top of one of said side panels and an outer major flap portion extending from an end of said outer major flap and joined to said ear side panel portion.

According to another aspect of the present invention, there is provided a carton blank, comprising: a first main panel; a second main panel; a medial side panel hinged to said first main panel at a hinge line and to said second main panel at a hinge line; a first major flap hinged to said first main panel at a hinge line; a second major flap hinged to said second main panel at a hinge line, said second major flap having a fold line extending the length of said second major flap and paralleling said hinge line between said second major flap and said second main panel; a medial ear panel hinged to said medial side panel at a hinge line, hinged to said first major flap at a hinge line and hinged to said second major flap at a hinge line.

Other aspects of the invention will become apparent after a review of the following description and drawings.

BRIEF DESCRIPTION OF THE DRAWINGS

In the figures which illustrate an embodiment of the invention.

DETAILED DESCRIPTION

Figure 1:
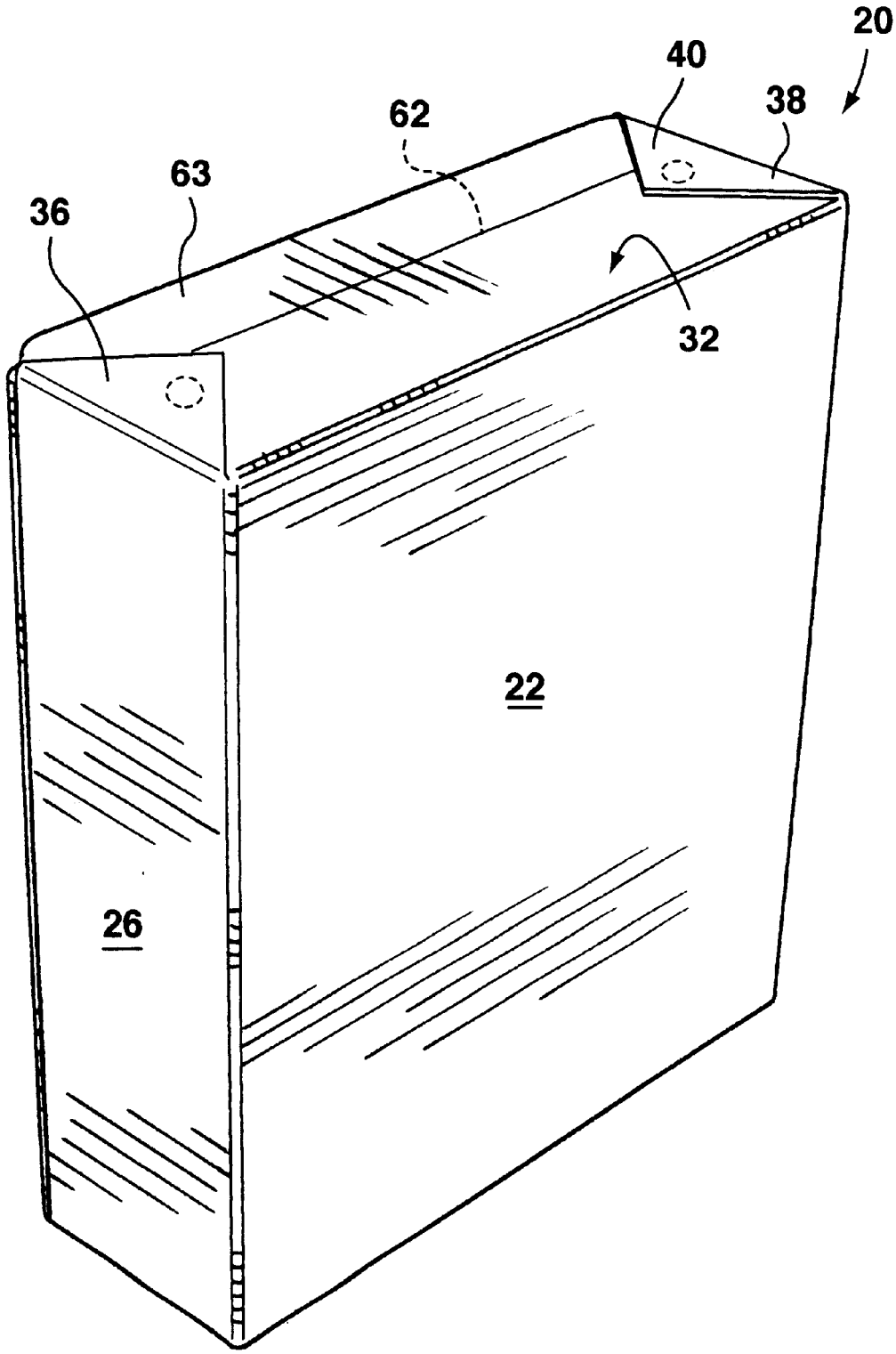
FIG. 1 is a perspective view of a carton.
Figure 9:
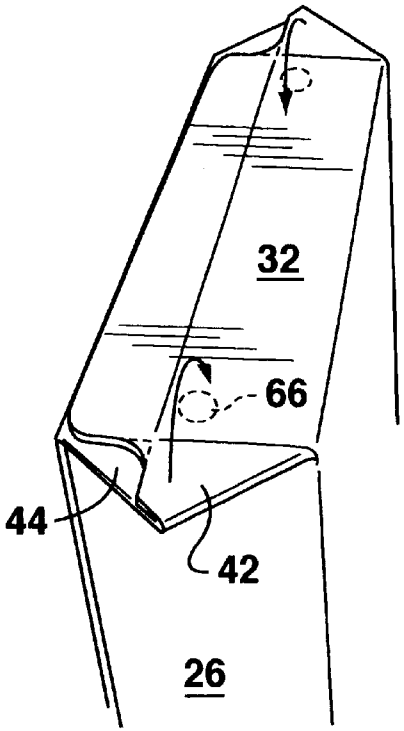
Figure 7:
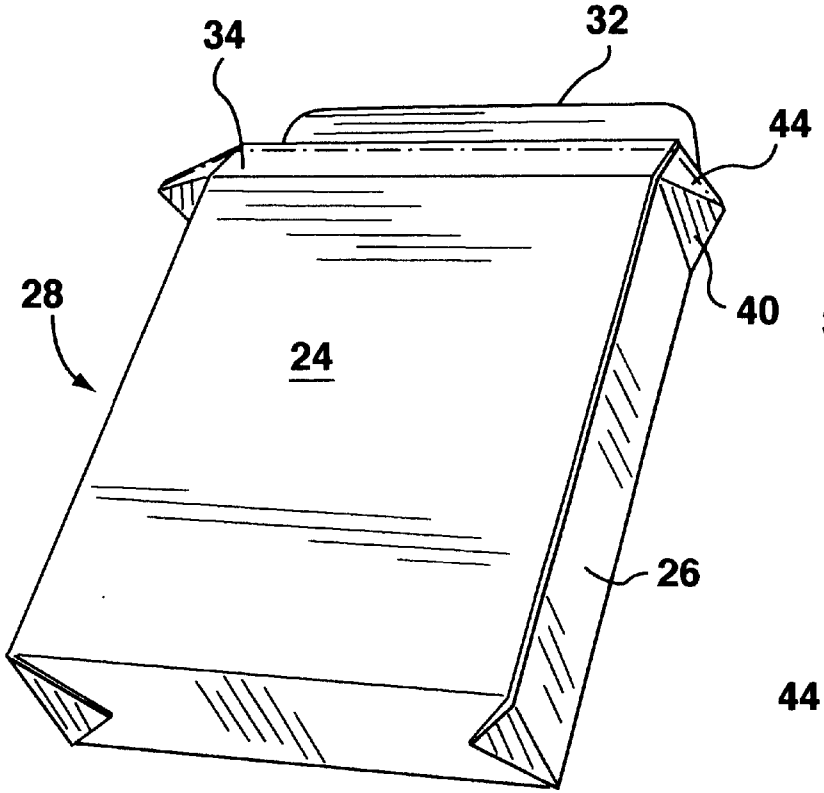

Turning to FIGS. 1, 7 and 9, a carton 20 has two main panels 22 and 24 with a pair of side panels 26 and 28 hinged therebetween. At the top of the carton, an inner major flap 34 is hinged to main panel 24 and an outer major flap 32 is hinged to panel 22. An ear 36, 38 projects outwardly from each end of the major flaps 32, 34 and is glued down to the outer major flap 32. Each ear has an ear side panel portion 40 hinged to the top of a side panel, an ear outer major flap portion 42 hinged to the outer major flap 32, and an ear inner major flap portion 44 hinged to the inner major flap 34.

The outer major flap 32 overlaps the inner major flap 34 and the ear portions 42 extending from the outer major flap 32 overlap respective ear portions 44 extending from the inner major flap 34. There is an adhesive bond along this overlapping portion between an inside face of the outer major flap 32 and its ear portions 42 on the one hand and the outside face of the inner major flap 34 and its upper ear portions 44 on the other. Each ear 36, 38 is bonded to the outer major flap 32.

Figure 6:
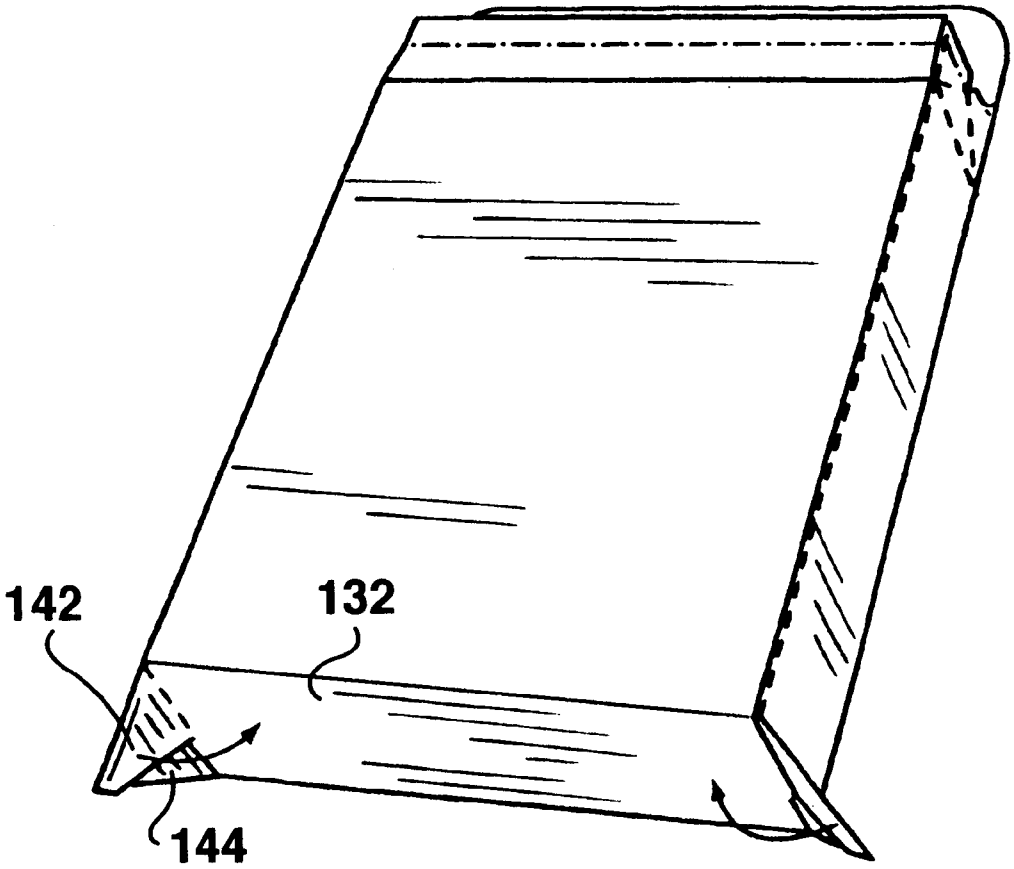

With reference to FIGS. 6 and 7, it is noted that the bottom of the carton is similarly configured with an inner major flap 134 and respective ear portions 144 overlapped by, and bonded to, an outer major flap 132 and respective ear portions 142. Additionally, the ears 136, 138 are bonded to the outer major panel 132. Alternatively, ears 136, 138 could also be bonded to side panels 26, 28.

Figure 2:
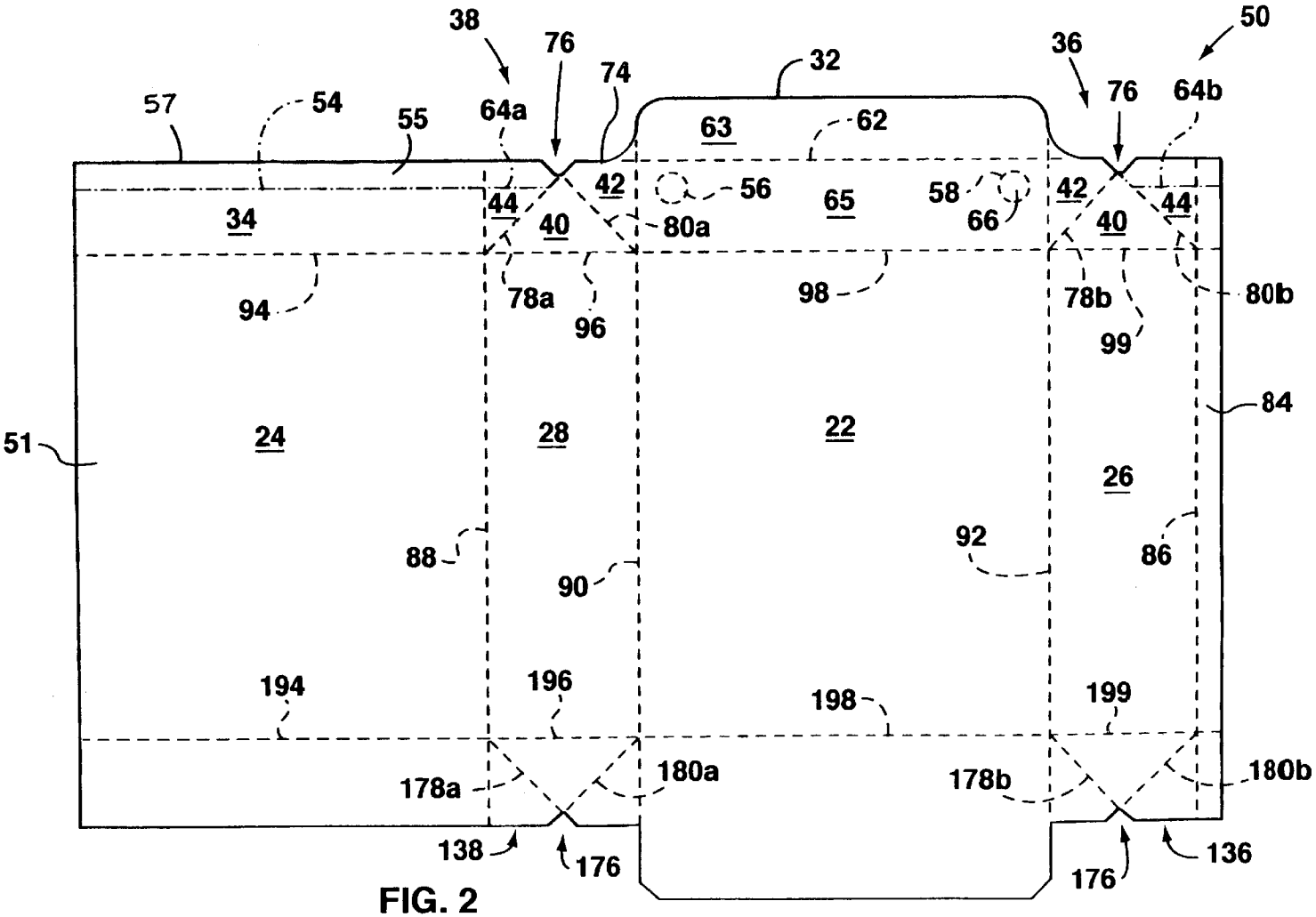
FIG. 2 is a perspective view of a carton blank from which the carton of FIG. 1 may be manufactured.

Returning to FIGS. 1 and 7, and also referencing FIG. 2, which shows a carton blank 50 from which carton 20 is manufactured, a weakened line 54 extends along the inner major flap 34 and weakened lines 64*a*, 64*b* extend along each of ear portions 44. The weakened lines 54, 64*a*, 64*b* are aligned so as to form one continuous weakened line in the completed carton. These weakened lines may be cut scores, lines of perforation, or the like. These weakened lines define a marginal portion 55 along which the aforementioned adhesive bond extends.

The outer major panel 32 has weakened lines 56, 58 formed as closed (circular) shapes 66. These weakened lines extend from the outside face of the carton 20 to a depth which is less than the thickness of the outer major flap. (This depth may be 50% of the thickness of the outer major flap.) The adhesive bond between each ear 36, 38 and the outer major flap 32 extends within one of these closed shapes 66.

The outer major flap 32 has a medial fold line 62 which may overlie the free edge 57 of the inner major flap 34. The medial fold line 62 defines a base 65 and flap end portion 63 of outer major flap 34.

With particular reference to FIG. 2, in the carton blank 50, each ear 36, 38 has a free edge 74 with a notch 76; this notch facilitates overlapping of the ear portions 42, 44. A fold line 78*a* extends in ear 38 from a top corner of main panel 24 to notch 76. A second fold line 80*a* extends in ear 38 from a top corner of main panel 22 to the notch 76. Similar fold lines 78*b* and 80*b* extend in ear 36, however, fold line 80*b* extends from a top corner of margin strip 84 defined by hinge line 86. It will also be noted that ears 136 and 138 at the bottom of the carton blank have similar notches 176 and fold lines 178*a*, 178*b*, 180*a*, 180*b*.

Carton blank 50 also shows hinge line 88 between main panel 24 and side panel 28; hinge line 90 between main panel 22 and side panel 28; and hinge line 92 between main panel 22 and side panel 26. Additionally is shown: a hinge line 94 between main panel 24 and inner major flap 34; hinge line 96 between side panel 28 and ear 38; hinge line 98 between main panel 22 and outer major flap 32; hinge line 99 between side panel 26 and ear 36; and similar hinge lines 194, 196, 198, and 199 at the bottom of the blank.

Note that a fold line may be structurally indistinguishable from a hinge line; the two terms were herein merely to indicate a different function.

To adapt the carton blank 50 for use with foods, an air impermeable coating 51 should be applied to the interior face of the blank.

Figure 3:
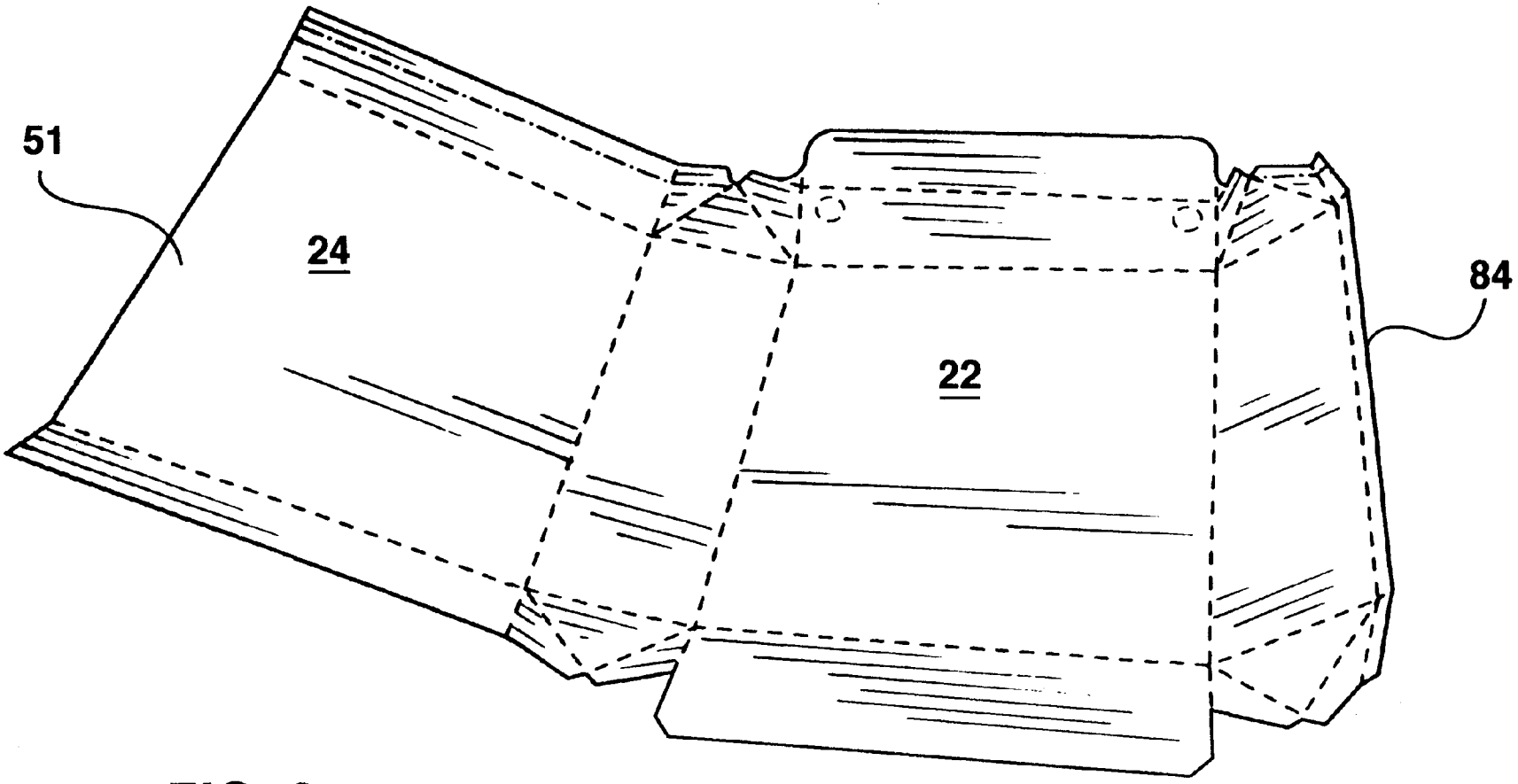
FIGS. 3 to 10 are perspective views illustrating the manufacture of the carton from the blank of FIG. 2, FIGS. 11 to 16 are perspective views illustrating opening and re-closing of the carton of FIG. 1.
Figure 5:
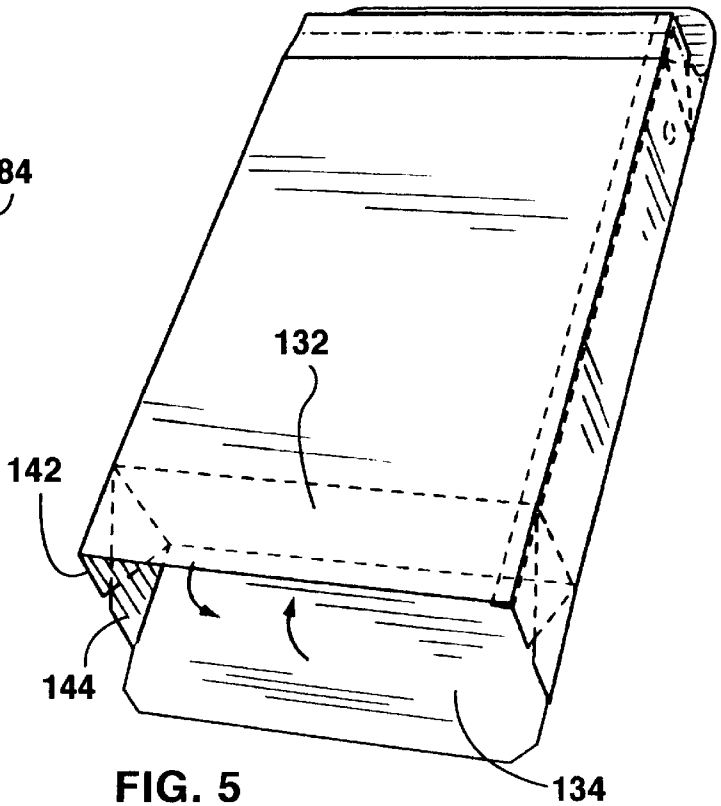
Figure 4:
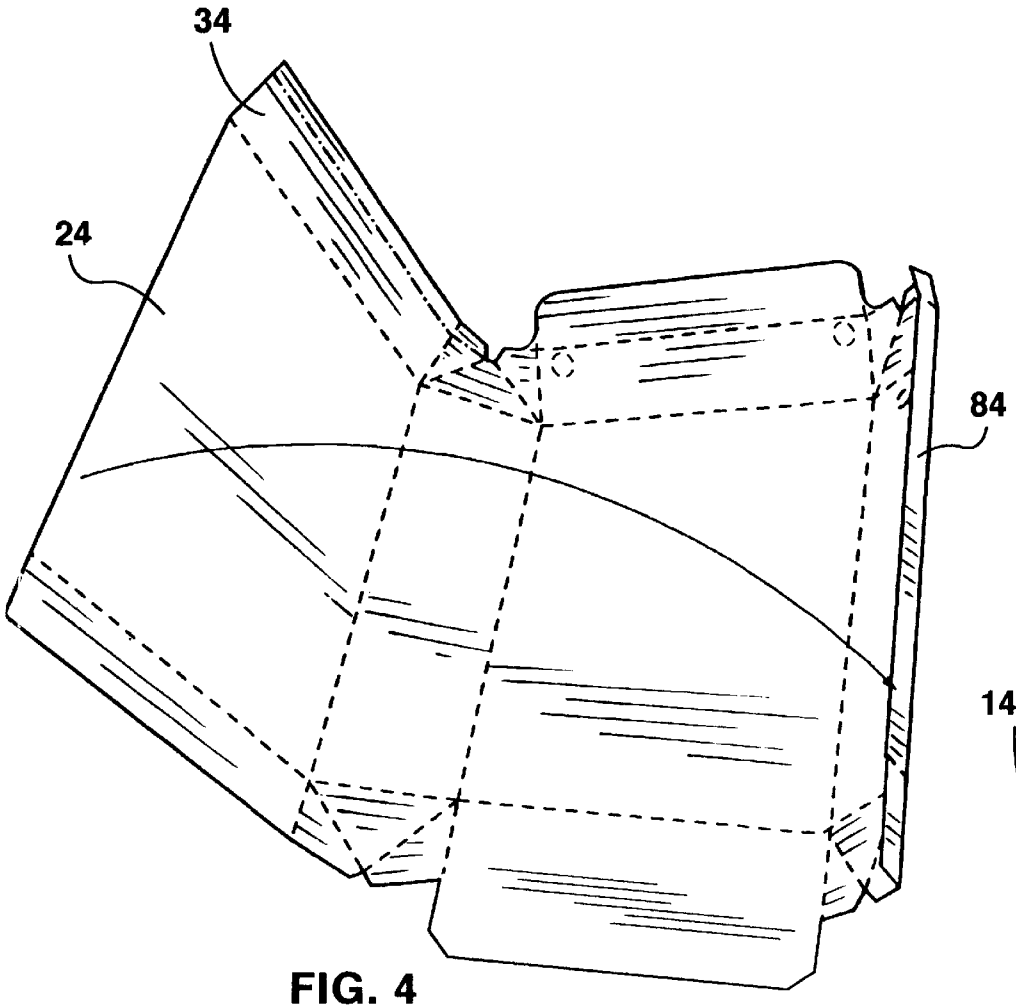

To manufacture a carton 20 of FIG. 1 from a carton blank 50 of FIG. 2, adhesive is to applied one or both of the outside face of margin strip 84 and the inside face of a margin of main panel 24 and inner major flap 34. The carton is formed into a sleeve as illustrated in the sequence of FIGS. 3 to 5 with the margin strip 84 bonded to the margin of main panel 24 and inner major flap 34 by the applied adhesive. Next, the bottom inner major flap 134 is folded down and its attached ear portions 144 are folded down and out. Adhesive is applied to either or both of the margin of the outside face of the inner major flap 134 and its ear portions 144 or to the inside face of the outer major flap 132 and its ear portions 142. The outer major flap and its ear portions 142 are then folded over, and bonded to, the inner major flap 134 with its ear portions 144, as seen in FIG. 6. The notches in the ear-halves permit ear portion 142 to be folded over ear portion 144 without interference.

With the ear portions 144 folded down and out, inner major flap 134 is supported at either of its ends by the bottom edge of side panels 26, 28. This sufficiently supports the inner major flap so that the outer major flap may be pressed thereagainst to bond the two in the absence of a mandrel behind the inner major flap. Thus, a mandrel is optional. Also, in consequence of the self-supporting inner flap, a hot melt adhesive may be employed as the applied adhesive.

Next adhesive is applied to the outside face of outer major flap 132 and the ears 136, 138 are folded around and bonded to the outer major flap 132, as seen in FIG. 6. This completes the bottom of the carton.

Figure 8:
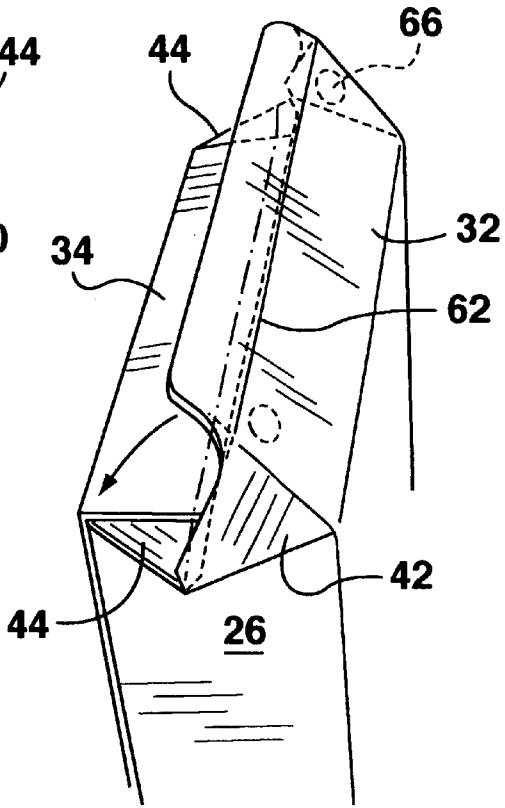
Figure 10:
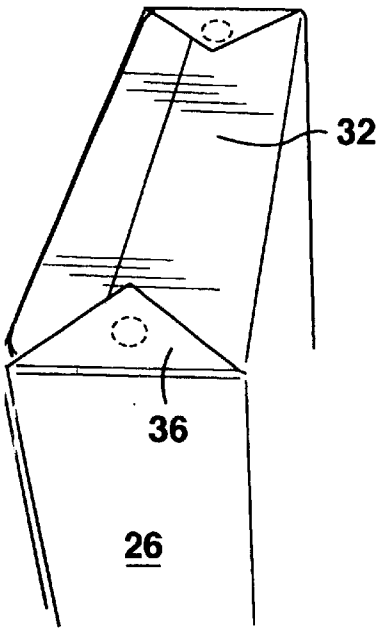

The carton with its completed bottom may then be filled. After filling, the top inner major flap 34 is folded down and its attached ear portions 44 are folded down and out. This is shown, progressively, in FIGS. 7 and 8. As seen in FIG. 8, this results in the top edge of side panels 26, 28 supporting the ends of the inner major flap 34. Adhesive (which may be hot melt) is applied to either or both of the margin 55 of the outside face of the inner major flap 34 and the margin of its ear portions 44 or to the inside face of the outer major flap 32 inwardly from fold line 62 and to the margins of its ear portions 42. The outer major flap and its ear portions 42 are then folded over, and bonded to, the inner major flap 34 with its ear portions 44, as seen in FIG. 9. Lastly, a spot of adhesive may be applied in each closed shape 66 of side panels 26, 28 and each (now bonded) ear 36, 38 may be folded down and bonded to its respective side panel, as seen in FIG. 10.

It will be apparent that with a line of adhesive forming a bond from ear-to-ear at both the top and bottom of the carton 20, there are no pin hole openings to the interior of the carton. Thus, at least where the carton has an air impermeable coating, the carton is air tight. Consequently, carton 20 may be used as a bagless cereal box.

Optionally, the top of the carton 20 may be closed first, the carton bottom-filled, and then the bottom of the carton sealed closed. This has the advantage that it allows use of a mandrel when sealing the top of the carton, which assists in ensuring a good seal at the top of the carton where adhesive may only bond the marginal portion 55 of inner major flap 34. The seal at the bottom is more easily ensured in the absence of a mandrel than is the seal at the top because a greater amount of adhesive can be used than can be used at the top. For example, a bead may be applied to the outer surface of the inner major flap 134 and a spaced parallel bead applied to the inner surface of the outer major flap 132.

Figure 11:
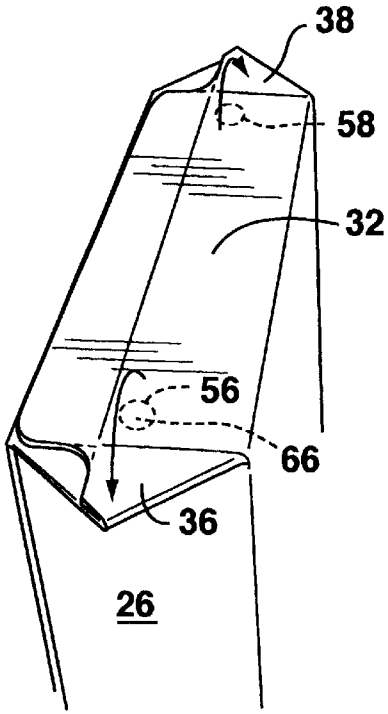

To open carton 20, ears 36, 38 are grasped and pulled away from outer major flap 32, as seen in FIG. 11. The weakened lines 56, 58 in the outer major flap, which extend to a depth which is less than the thickness of the outer major flap, facilitates this. More particularly, it is not necessary for the adhesive bond between the ears and outer major flap to be broken as carton material within closed shapes 66 simply pulls away with the ears. Because the weakened lines 56, 58 do not extend to the depth of the outer major flap, the carton remains impermeable to air even after the ears are pulled away.

Figure 13:
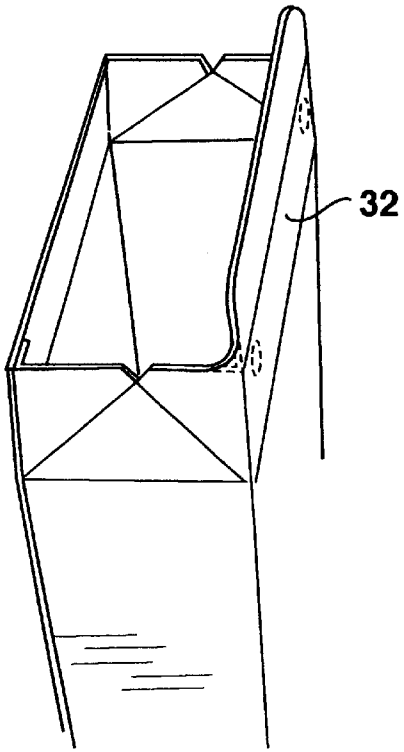
Figure 12:
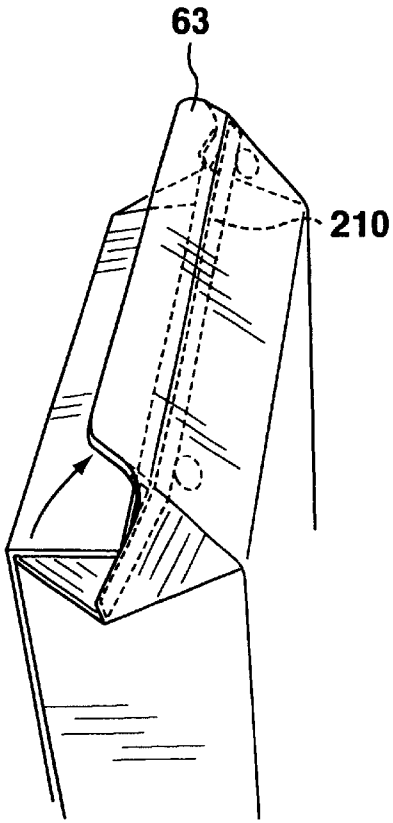

Next, the flap end portion 63 of the outer major flap 32 may be grasped and pulled back, as shown in FIG. 12. This causes the weakened lines 54, 64*a*, 64*b* (FIG. 2) to give way resulting in a tear strip 210 (which previously was the marginal portion 55 of the inner major flap and the marginal portion of its ear portions 44) pulling away with the outer major flap 32. Thus, this does not require breaking the adhesive bond between the outer and inner major flaps 32 and 34, nor between their respective ear portions 42 and 44. After the outer major flap has been pulled back, the interior of the carton may be accessed, as shown in FIG. 13.

Figure 16:
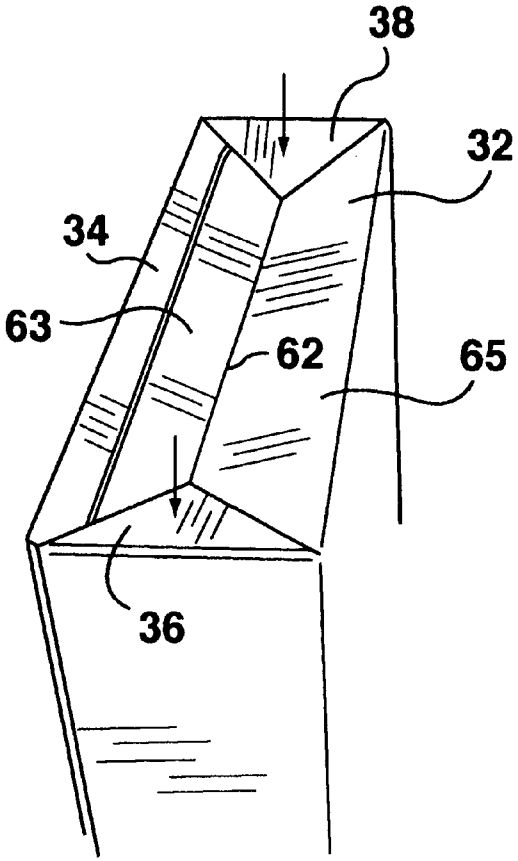
Figure 15:
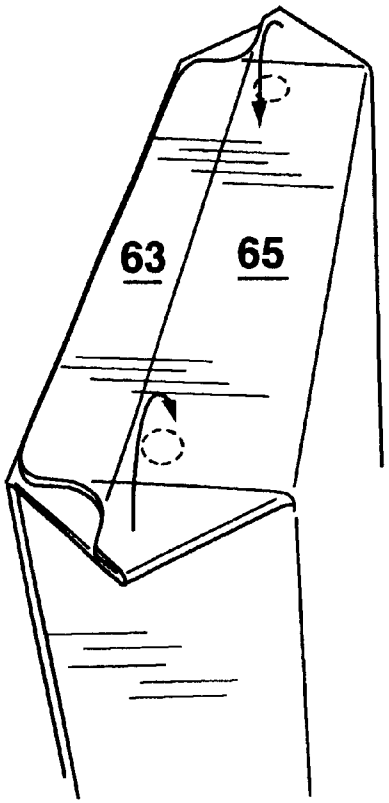
Figure 14:
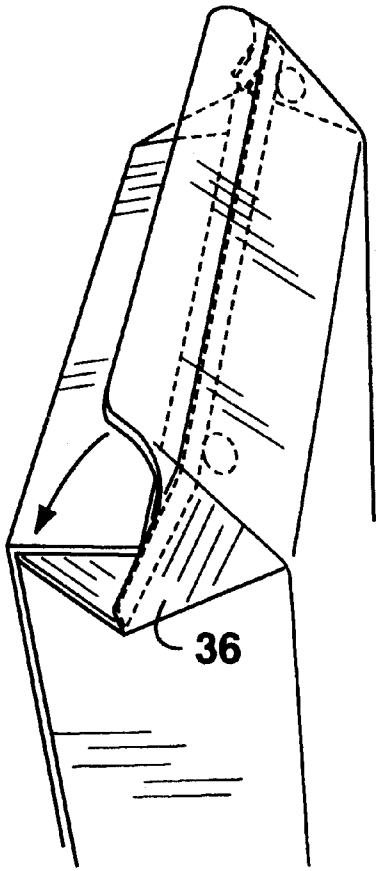
Figure 17:
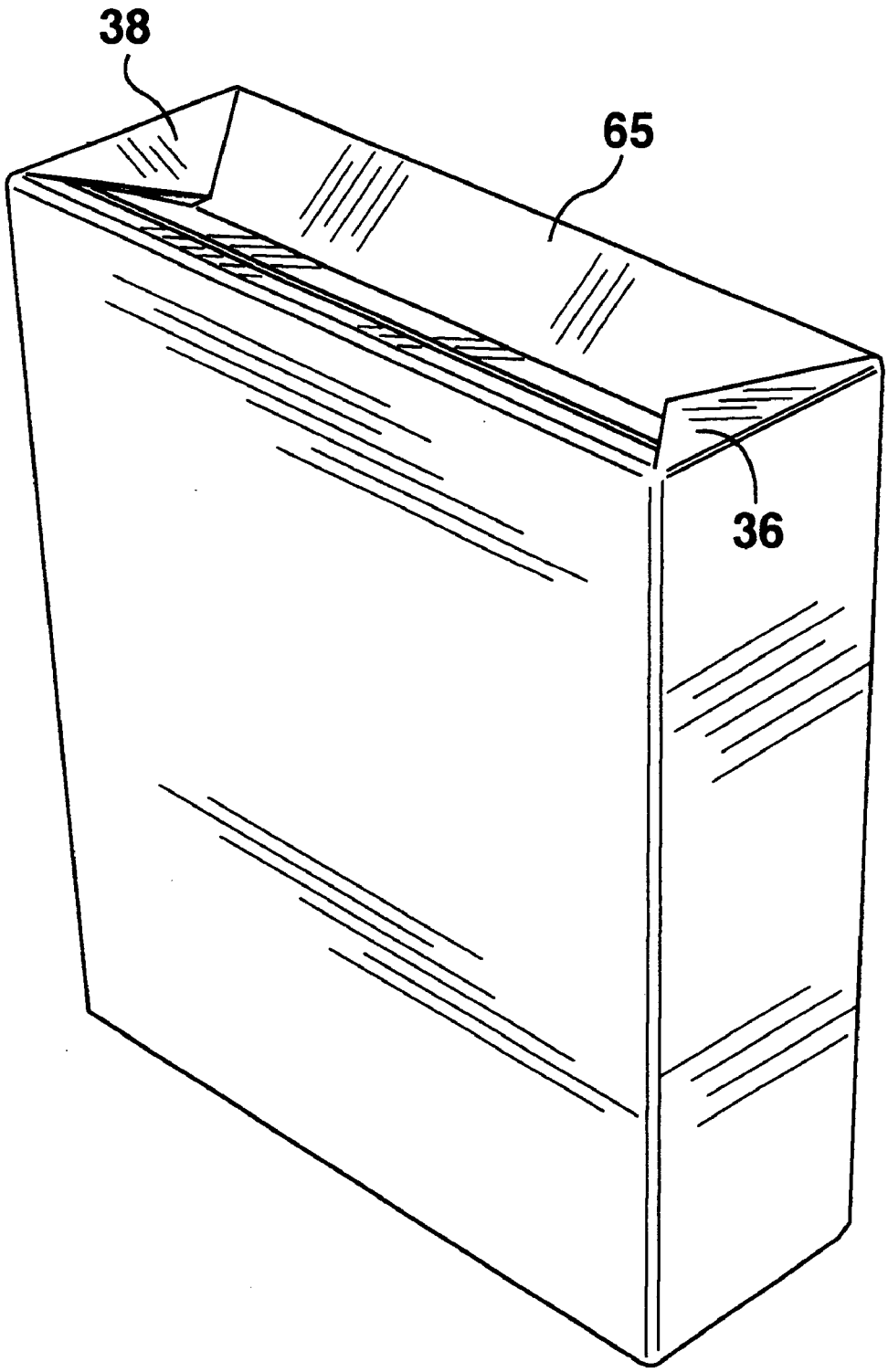
FIG. 17 is a perspective view of a re-closed carton.

To re-close the carton, the ears 36, 38 may be folded outwardly, as seen in FIG. 14, this pulls the inner major flap 34 (now without marginal portion 55) and outer major flap 32 downwardly as seen in FIG. 15. The ears 36, 38 are then folded over top of the outer major flap 32 and pushed downwardly, as seen in FIG. 16. This causes the outer major flap 34 to bend inwardly at its fold line 62 so as to have a concave V-shaped profile. Ear portions 42 are hinged to the base 65 of outer major flap 32. Thus, when the outer major flap assumes its concave V-shaped profile, the downwardly directed base 65 draws ear portions 42 downwardly and away from their ear side panel portions 40. Additionally, the outer major flap forces the inner major flap 34 downwardly. This, in turn, draws ear portions 44, which are hinged to the inner major flap 34, downwardly and away from their ear side panel portions 40. This has the effect of "latching " the ears in place such that the carton can only be re-opened by first pulling the ears away from the outer major panel.

With the carton re-closed, a wide band of base 65 of outer major flap 32 abuts the inner major flap 34. This provides a reasonable seal at the top of the carton.

Optionally, the inner and outer major flaps 132, 134 may be embossed so that the ears 136, 138 are more flush with the bottom of carton 20. Alternatively, the bottom ears 136, 138 may be folded around and glued to side panels 26, 28, rather than being folded around and glued to outer major flap 132.

Other modifications will be apparent to those skilled in the art and, therefore, the invention is defined in the claims.

What is claimed is:

1. A carton comprising:

a first main panel;

a second main panel;

a pair of opposed side panels hinged between said main panels;

an inner major flap extending along said first main panel and hinged thereto;

an outer major flap extending along said second main panel and hinged thereto, said outer major flap having a width so as to overlap along its length with said inner major flap;

a fold line extending the length of said outer major flap and paralleling a hinge line joining said outer major flap to said second main panel;

a pair of opposed outwardly projecting ears, each ear having a side panel portion extending from a top of one of said side panels and an outer major flap portion extending from an end of said outer major flap and joined to said ear side panel portion;

said outer major flap being folded inwardly at said fold line to form a concave V-shape, said concave V-shape drawing said ears downwardly.

2. The carton of claim 1 wherein said inner major flap has a free edge proximate said outer major flap fold line.

3. The carton of claim 1 wherein each ear also has an inner major flap portion extending from an end of said inner major flap and joined to said ear side panel portion.

4. The carton of claim 3 wherein, for each ear, one of said ear inner major flap portion and said ear outer major flap portion has a width so as to provide an overlap along its length with another of said ear inner major flap portion and said ear outer major flap portion.

5. The carton of claim 1 wherein, for each ear, said ear side panel portion is hinged to said ear outer major flap portion.

6. The carton of claim 4 further comprising, for each ear, a notch between said ear outer major flap portion and said ear inner major flap portion.

7. The carton of claim 1 further comprising an air impermeable coating on its interior surface.

8. The carton of claim 4 wherein, for each ear, said ear side panel portion is hinged to said ear outer major flap portion and said ear inner major flap portion.

9. A carton comprising:

a first main panel;

a second main panel;

a pair of opposed side panels hinged between said main panels;

an inner major flap extending along said first main panel and hinged thereto;

an outer major flap extending along said second main panel and hinged thereto, said outer major flap having a width so as to overlap along its length with said inner major flap;

proximate each end of said outer major flap, an outer major flap weakened line defining a closed shape, each outer major flap weakened line extending from an outside face of said outer major flap to a depth less than a thickness of said outer major flap;

a pair of opposed outwardly projecting ears, each ear having a side panel portion extending from a top of one of said side panels and an outer major flap portion extending from an end of said outer major flap and joined to said ear side panel portion;

an adhesive bond between said each ear and said outer major flap extending within one said closed shape.

10. The carton of claim 9 wherein each ear also has an inner major flap portion extending from an end of said inner major flap and joined to said ear side panel portion.

11. The carton of claim 10 further comprising an adhesive bond between an inside face of said outer major flap and an outside face of said inner major flap along said overlap of the flaps and between said ear inner major flap portion and said ear outer major flap portion along said overlap of the ear portions.

12. The carton of claim 11 further comprising a weakened line along said inner major flap so as to provide an inner major flap marginal portion, said adhesive bond extending along said inner major flap marginal portion.

13. The carton of claim 12 wherein said outer major flap fold line overlies said inner major flap weakened line.

14. The carton of claim 13 further comprising, for each ear, a weakened line along said ear inner major flap portion so as to provide an ear marginal portion, said adhesive bond extending along said ear marginal portion.

15. The carton of claim 14 wherein each said ear weakened line is aligned with said inner major flap weakened line to form a continuous weakened line extending in and from one ear, through said inner flap, into said other ear.

16. A carton comprising:

a first main panel;

a second main panel;

a pair of opposed side panels hinged between said main panels;

an inner major flap extending along said first main panel and hinged thereto;

a weakened line extending along the length of said inner major flap so as to define an inner major flap marginal portion between a free edge of said inner major flap and said weakened line;

an outer major flap extending along said second main panel and hinged thereto, said outer major flap having a width so as to overlap along its length with said inner major flap;

a fold line extending the length of said outer major flap along said free edge of said inner major flap;

a pair of opposed outwardly projecting ears, each ear having a side panel portion extending from a top of one of said side panels and an outer major flap portion extending from an end of said outer major flap and joined to said ear side panel portion.

17. The carton of claim 16 further comprising an adhesive bond between said inner major flap marginal portion and said outer major flap.

18. A carton blank, comprising:

a first main panel;

a second main panel;

a medial side panel hinged to said first main panel at a hinge line and to said second main panel at a hinge line;

a first major flap hinged to said first main panel at a hinge line;

a second major flap hinged to said second main panel at a hinge line;

proximate each end of said second major flap, a second major flap weakened line defining a closed shape, each second major flap weakened line extending from an outside face of said second major flap to a depth less than a thickness of said second major flap;

a medial ear panel hinged to said medial side panel at a hinge line, hinged to said first major flap at a hinge line and hinged to said second major flap at a hinge line.

19. The carton blank of claim 18 further comprising a fold line extending the length of said second major flap and paralleling said hinge line between said second major flap and said second main panel.

20. The carton blank of claim 19 further comprising a weakened line extending along said first major flap to said hinge line between said medial ear panel and said first major flap.

21. The carton blank of claim 20 further comprising an air impermeable coating on its interior face.

22. The carton blank of claim 21 further comprising a weakened line extending in said medial ear panel from said hinge line between said medial ear panel and said first major flap.

23. The carton blank of claim 22 wherein said weakened line in said first major flap is aligned with, and meets, said weakened line in said medial ear panel so as to form a continuous weakened line which extends along said first major flap and into said medial ear panel.

24. A carton blank comprising:

a first main panel;

a second main panel;

a medial side panel hinged to said first main panel at a hinge line and to said second main panel at a hinge line;

a first major flap hinged to said first main panel at a hinge line;

a weakened line extending along the length of said first major flap so as to define an inner major flap marginal portion between a free edge of said inner major flap and said weakened line;

a second major flap hinged to said second main panel at a hinge line;

a fold line extending the length of said second major flap aligned with said free edge of said inner major flap;

a medial ear panel hinged to said medial side panel at a hinge line, hinged to said first major flap at a hinge line and hinged to said second major flap at a hinge line.

25. A method of re-closing a carton of a type having a first main panel; a second main panel; a pair of opposed side panels hinged between said main panels; an inner major flap extending along said first main panel and hinged thereto; an outer major flap extending along said second main panel and hinged thereto, said outer major flap having a width so as to overlap along its length with said inner major flap; a fold line extending the length of said outer major flap and paralleling a hinge line joining said outer major flap to said second main panel; a pair of opposed outwardly projecting ears, each ear having a side panel portion extending from a top of one of said side panels and an outer major flap portion extending from an end of said outer major flap and joined to said ear side panel portion, comprising:

folding said outer major flap inwardly at said fold line to form a concave V-shape, said concave V-shape drawing said ears downwardly.

* * * * *